US011610517B2

(12) United States Patent
Kaufman

(10) Patent No.: US 11,610,517 B2
(45) Date of Patent: Mar. 21, 2023

(54) MARKING DEVICES AND METHODS OF DISPLAYING INDICIA IN A MARKING DEVICE

(71) Applicant: American Labelmark Company, Chicago, IL (US)

(72) Inventor: Michael J. Kaufman, Morton Grove, IL (US)

(73) Assignee: AMERICAN LABELMARK COMPANY, Chicago, IL (US)

( * ) Notice: Subject to any disclaimer, the term of this patent is extended or adjusted under 35 U.S.C. 154(b) by 14 days.

(21) Appl. No.: 17/092,294

(22) Filed: Nov. 8, 2020

(65) Prior Publication Data

US 2022/0148462 A1 May 12, 2022

(51) Int. Cl.

| | |
|---|---|
| ***G09F 7/00*** | (2006.01) |
| ***G09F 21/04*** | (2006.01) |
| ***B65D 25/20*** | (2006.01) |

(52) U.S. Cl.

CPC ..... *G09F 7/00* (2013.01); *B65D 25/205* (2013.01); *G09F 21/048* (2013.01)

(58) Field of Classification Search

CPC ..... G09F 7/00; G09F 21/048; G09F 21/04; B65D 25/205

See application file for complete search history.

(56) References Cited

U.S. PATENT DOCUMENTS 1,712,302 A * 5/1929 Harris ..... B42D 5/041 40/120
2,065,624 A * 12/1936 Summers ..... A63B 71/0672 116/223
3,481,060 A * 12/1969 Hartz ..... G09F 7/22 40/591
3,496,666 A * 2/1970 Morley ..... G09F 7/22 40/591
3,518,782 A * 7/1970 Long ..... G09F 7/22 116/28 R
4,005,536 A * 2/1977 Fanning, Jr. ..... G09F 11/06 40/533

(Continued)

OTHER PUBLICATIONS

Orange ID No. 5—Panel Flip Set. Product Sheet [online]. J. J. Keller, 2021 [retrieved on Jan. 19, 2021]. Retrieved from the internet: https://www.jjkeller.com/shop/Product/Orange-ID-Number-5-Panel-Flip-Set?PromoCode=205087&cm_mmc=Google-_-ProductFeed-_-014590-_-56525&utm_source=google&utm_medium=cpc&adpos=&scid=scplp56525&sc_intid=5652&PromoCode=205087&gclid=Cj0KCQiA0fr_BRDaARIsAABw4EuMRJVvLn0En1fOFh1a1PUajM0N10Hsc2Lzl3jNXMurCjau5YBK3qgaAiIJEALw_wcB (4 pages).

(Continued)

*Primary Examiner* — Cassandra Davis
(74) *Attorney, Agent, or Firm* — McCracken & Gillen LLC

(57) ABSTRACT

A marking device for displaying indicia and a method of displaying indicia in a marking device are disclosed. The method includes a substantially rectangular marking device frame comprising first and second edges parallel to a first axes and a third and fourth edges parallel to a second axis, wherein the first and second axes are orthogonal. A first set of tiles and a second set of tiles are secured to the marking device frame. The first set of tiles and the second set of tiles are disposed adjacent to one another along the first axis. A first tile of the first set of tiles is exposed to display a first portion of the indicia printed thereon and a second tile of the second set of tiles is exposed to display a second portion of the indicia printed thereon.

20 Claims, 6 Drawing Sheets

(56) References Cited

U.S. PATENT DOCUMENTS

| | | | | | |
|---|---|---|---|---|---|
| 4,058,918 | A * | 11/1977 | Fund | B60R 13/10 | 40/590 |
| 4,178,710 | A * | 12/1979 | Schmid | G09F 7/22 | 402/21 |
| 6,481,054 | B1 * | 11/2002 | Hillstrom | G09F 15/0056 | 16/253 |
| 6,665,967 | B1 * | 12/2003 | Quackenbush | G09F 21/04 | 40/611.12 |
| 7,043,859 | B1 * | 5/2006 | Meyer | G09F 11/02 | 40/497 |
| 10,204,533 | B2 * | 2/2019 | Kucksdorf | G09F 7/18 | |

OTHER PUBLICATIONS

4 Legend Flip Placard System for Tankers. Product Sheet [online]. Labelmaster, 2021 [retrieved on Jan. 19, 2021]. Retrieved from the internet: https://www.labelmaster.com/shop/placarding-systems/flip-placard-systems-for-tankers-duo-flip/4-legendflip-placard-system-for-tankers/ (3 pages).

UN 1760 Orange Panel, Removable Vinyl, Pack of 25. Product Sheet [online]. Labelmaster, 2021 [retrieved on Jan. 19, 2021]. Retrieved from the internet: https://www.labelmaster.com/shop/placards/orange-panels/un1760-orange-panels/un-1760-orange-panelremovable-vinyl-pack-of-25-zopez1760 (3 pages).

* cited by examiner

MARKING DEVICES AND METHODS OF DISPLAYING INDICIA IN A MARKING DEVICE

FIELD OF DISCLOSURE

The present subject matter relates to a marking device for a vehicle or container, and more particularly, to a marking device that may be used to display various indicia.

BACKGROUND

A marking device, a placard, a label, and the like having indicia thereon may be secured to a container used to carry or move different products. Such container may be one of an intermediate bulk container, a trailer, railcar, truck, tank (rail or storage), or other vehicle body, a building, or other movable or stationary item. Such indicia may be a sequence of characters specified by a regulatory organization (e.g., the U.S. Department of Transportation, the International Maritime Organization, and the like), that identifies the contents of the container and whether special care needs to be taken during transport or storage of such contents.

Preprinted panels having particular indicia imprinted thereon associated with particular materials and placard frames that hold such panels are commercially available. The placard frame is secured to a container and a preprinted placard is removably inserted or secured to the placard frame to identify the contents of the container. For example, when the container is used to hold first contents, a first preprinted placard associated with the first contents is selected from a plurality of preprinted placards and inserted into the frame. Thereafter, when the container is used to hold second contents, the first preprinted placard is removed from the placard frame and a second preprinted placard associated with the second contents is selected from the plurality of preprinted placards and inserted into the frame. Alternately, a preprinted label may be affixed to the container using, for example, an adhesive. The user must acquire and maintain an inventory of the plurality of preprinted placards or labels to ensure that a placard or label having particular indicia is available when needed.

Placards having movable indicia are also used. A typical design comprises alphanumeric characters and/or symbols printed on members (sometimes referred to as tiles or cards) that can be flipped about a diagonal of a diamond shaped placard to permit display of the characters/symbols. The tiles typically comprise metal substrates that can stand up to the elements and which receive printing thereon. Each tile is typically printed with a portion of an alphanumeric character and/or symbol and the tiles are arranged such that flipping the tiles causes an entire character/symbol to be displayed by two or more tiles.

SUMMARY

According to one aspect, a marking device for displaying indicia includes a substantially rectangular marking device frame comprising first and second edges parallel to a first axis and third and fourth edges parallel to a second axis intersecting the first axis. The first axis and the second axis are orthogonal and define a display direction for the indicia normal to the first axis and the second axis. The marking device also includes a first set of tiles and a second set of tiles secured to the marking device frame. The first set of tiles comprises a first portion of the indicia and the second set of tiles comprises a second portion of the indicia. In addition, the first set of tiles and the second set of tiles are disposed adjacent to one another along the first axis and each set of tiles is movable about a first line parallel to the first axis. A first tile of the first set of tiles is exposed to display the first portion of the indicia and a second tile of the second set of tiles is exposed to display a second portion of the indicia. The marking device also includes a securing member movable about a second line parallel to the second axis between a securing position at which the securing member engages the first set of tiles and the second set of tiles thereby preventing movement of the first and second sets of tiles about the first line and a non-securing position out of engagement with the first set of tiles and the second set of tiles thereby permitting movement of the sets of tiles about the first line.

According to another aspect, a marking device for displaying indicia includes a substantially rectangular marking device frame comprising first and second edges parallel to a first axis and third and fourth edges parallel to a second axis, wherein the first and second axes are orthogonal. The marking device also includes a first set of tiles secured to the marking device frame and a second set of tiles secured to the marking device frame. The first set of tiles and the second set of tiles are disposed adjacent to one another along the first axis, a first tile of the first set of tiles is exposed to display a first portion of the indicia, and a second tile of the second set of tiles is exposed to display a second portion of the indicia. The first set of tiles is secured to the marking device frame by a first hinge, the second set of tiles is secured to the marking device frame by a second hinge, and the first and second hinges are disposed along a line parallel to the first axis. Rotating the first tile of the first set of tiles about the first hinge exposes a third tile of the first set of tiles. The marking device further includes a securing portion movable from a securing position to a non-securing position, wherein the first tile is rotatable about the hinge when the securing portion is in the non-securing position and is prevented from being rotated about the hinge when the securing portion is in the securing position. In addition, the securing portion comprises a first securing portion, the securing position comprises a first securing position, and the non-securing position comprises a first non-securing position, further comprising a second securing portion movable from a second securing position to a second non-securing position, wherein when the first securing portion is in the first non-securing position, the second securing portion is in the second securing position.

According to yet another aspect, a method of displaying indicia in a marking device, wherein the marking device includes a substantially rectangular marking device frame comprising first and second edges parallel to a first axis and third and fourth edges parallel to a second axis, wherein the first and second axes are orthogonal and define a display direction for the indicia normal to the first axis and the second axis, includes the steps of movably securing a first set of tiles to the marking device frame and movably securing a second set of tiles to the marking device frame. The first set of tiles comprising a first portion of the indicia, the second set of tiles comprising a second portion of the indicia, and the first set of tiles and the second set of tiles are disposed adjacent to one another along the first axis. The method includes the additional steps of exposing one of the first set of tiles to display the first portion of the indicia including the step of moving the one of the first set of tiles about a first line parallel to the first axis, exposing one of the second set of tiles to display the second portion of the indicia including the step of moving the one of the second set of tiles about the first line parallel to the first axis, and moving a securing member about a second line parallel to the second axis into engagement with the one of the first set of tiles and the one of the second set of tiles to prevent movement of the one of the first and second set of tiles.

According to further aspect, a method of displaying indicia in a marking device, wherein the marking device includes a substantially rectangular marking device frame comprising first and second edges parallel to a first axis and third and fourth edges parallel to a second axis, wherein the first and second axes are orthogonal, includes the steps of securing a first set of tiles and a second set of tiles to the marking device frame, wherein the first set of tiles and the second set of tiles are disposed adjacent to one another along the first axis. The method also includes the steps of exposing one of the first set of tiles to display a first portion of the indicia, exposing one of the second set of tiles to display a second portion of the indicia, wherein securing the first set of tiles comprises securing the first set of tiles to the marking device frame by a first hinge, securing the second set of tiles comprises securing the second set of tiles to the marking device frame by a second hinge, and disposing first and second hinges along a line parallel to the first axis. In addition, the method includes the steps of rotating the first tile of the first set of tiles about the first hinge to expose a third tile of the first set of tiles, moving a securing portion from a securing position to a non-securing position to enable the first tile to rotate about the hinge and moving the securing portion from the non-securing position to the securing position to prevent the first tile from rotating about the hinge. The securing portion comprises a first securing portion, the securing position comprises a first securing position, and the non-securing position comprises a first non-securing position. The method also includes moving a second securing portion from a second securing position to a second non-securing position, wherein when the first securing portion is in the first non-securing position, the second securing portion is in the second securing position.

Other aspects and advantages will become apparent upon consideration of the following detailed description and the attached drawings wherein like numerals designate like structures throughout the specification.

DETAILED DESCRIPTION

As described in greater detail below, a substantially rectangular marking device is disclosed herein that comprises a marking device frame having first and second edges that extend parallel to a first axis and third and fourth edges that extend parallel to a second axis orthogonal to the first axis. The first through fourth edges define a cavity therebetween. The marking device frame includes a plurality of regions for displaying indicia in such cavity. The regions are disposed adjacent one another parallel to the first or second axes of the rectangular marking device. A set of tiles is secured in each region by a hinge such that each tile may be rotated (i.e., flipped) about the hinge. Each tile has a portion of a character (e.g., a portion of a letter or integer or portions of multiple letters and/or integers) and/or one or more symbols that comprises the indicia printed thereon. Adjacent tiles of the set combine to form the character/symbol(s). Thus, the tiles in each region may be selected to display a particular character/symbol(s) of the indicia. After the tiles are selected to display particular indicia, a securing member is positioned over the plurality of tiles and fastened by one or more clips to prevent further movement of the tiles. To change the indicia, the securing member is unfastened, the tiles rotated about the hinges as described above to select the characters/symbol(s) of another indicia, and the securing member is positioned and fastened once again.

Figure 1:
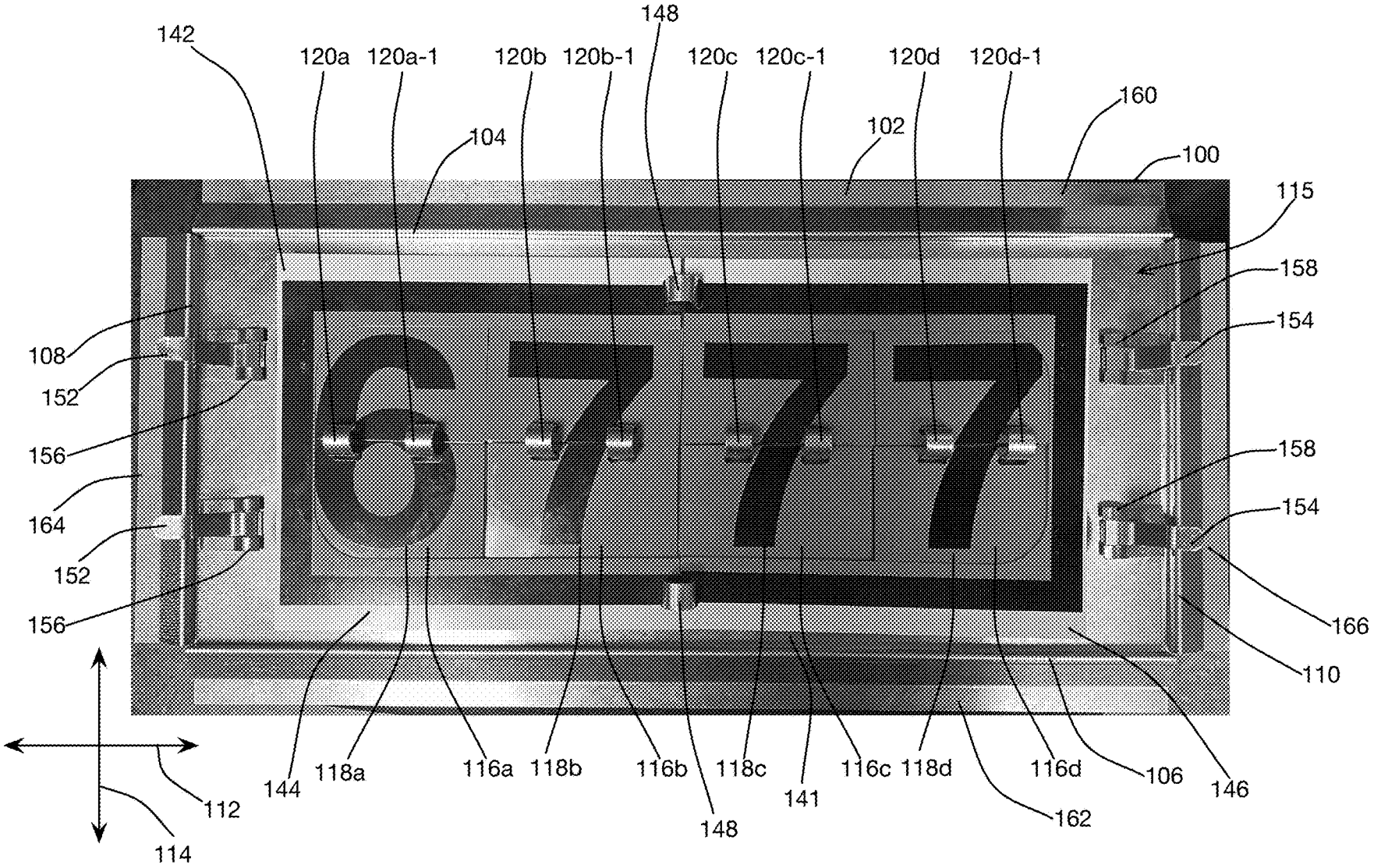
FIG. 1 is an elevational view of an embodiment of a marking device.

Referring to FIG. 1, a substantially rectangular marking device 100 comprises a marking device frame 102 having spaced apart first and second edges 104,106 and spaced apart third and fourth edges 108,110. The first and second edges 104,106 are substantially parallel to a first axis 112 and the second and third edges 108,110 are substantially parallel to a second axis 114, wherein the first and second axes 112,114 are transverse with respect to, and, more particularly, substantially orthogonal to one another. The first through fourth edges 104-110 define a cavity 115 therebetween.

The cavity 115 of the marking device frame 102 includes a plurality of adjacent regions 116*a*, 116*b*, 116*c*, and 116*d* in which the indicia may be displayed. In some embodiments, the rectangular marking device 100 may comprise additional cavities defined by one or more of the edges 104-110 and additional edges (not shown). Furthermore, each such additional cavity may have additional regions 116 in which indicia may be displayed.

Each indicia region 116 includes a set of tiles 118 rotatably secured to the marking device frame 102 by one or more hinges 120. For example, the embodiment of the marking device 100 shown in FIG. 1 includes a set of tiles 118*a* in the region 116*a* secured to the marking device frame 102 by a pair of hinges 120*a* and 120*a*-1. Similarly, the set of tiles 118*b* in the region 116*b* are secured to the marking device frame 102 by a pair of hinges 120*b* and 120*b*-1, the set of tiles 118*c* in the region 116*c* are secured to the marking device frame 102 by a pair of hinges 120*c* and 120*c*-1, and the set of tiles 118*d* in the region 116*d* are secured to marking device frame 102 by a pair of hinges 120*d* and 120*d*-1. Although the embodiment of the marking device 100 shown in FIG. 1 includes two hinges 120 used to secure each set of tiles 118 to the marking device frame 102, it should be apparent to one of ordinary skill in the art that, in other embodiments, one hinge 120 or more than two hinges 120 may be used to secure each set of tiles 118.

In some embodiments, all of the hinges 120 used to secure the sets of tiles 118 are disposed substantially colinearly relative to one another along a line substantially parallel to the axis 112. The tiles 118 secured by each hinge 120 rotate about such hinge along a direction substantially parallel to the axis 114.

Figure 1A:
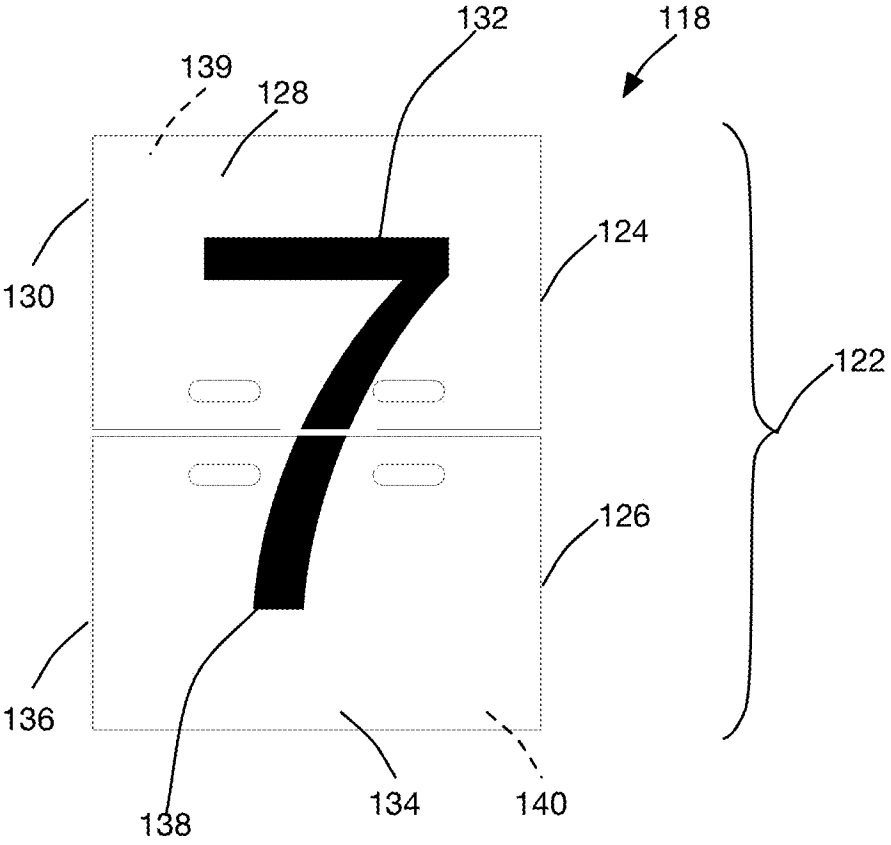
FIG. 1A is an elevational view of a set of tiles used to display indicia in the marking device of FIG. 1.

Referring to FIGS. 1 and 1A, each set of tiles 118 in a region 116 includes a predetermined number of tiles 122 stacked atop one another. In particular, a first subset 124 of the set of tiles 118 is stacked and disposed proximate the edge 104 and a second subset 126 of the remaining tiles (if any) in the set of tiles 118 is stacked and disposed proximate the edge 106.

A first surface 128 of the top-most tile 130 of the first subset 124 is exposed and a first portion 132 of the indicia imprinted thereon is visible in the region 116. Similarly, a second surface 134 of the top-most tile 136 (if any) of the second subset 126 is exposed and a second portion 138 of the indicia imprinted thereon is visible in the region 116. In some embodiments, the first and second portions 132,138 of the indicia combine to form a character/symbol (e.g., an alphanumeric character or symbol) that is displayed in the region 116 in which the set of tiles 118 is disposed.

When the top-most tile 130 of the first subset 124 is rotated about the hinge 120 so that the top most tile 130 is moved from a position proximate the edge 104 to a position proximate the edge 106, a surface 139 opposite the first surface 128 is exposed and any portion of the indicia imprinted thereon is made visible in the region 116 proximate the edge 106. Further, rotating the top-most tile 130 in this manner uncovers a further tile (if any) of the first subset 124 proximate the edge 104 and any indicia imprinted on a surface thereof is displayed.

Similarly, when the top-most tile 136 of the second subset 126 is rotated about the hinge 120 to move from a position proximate the edge 106 to a position proximate the edge 104, a surface 140 opposite the surface 134 is exposed and any portion of the indicia imprinted thereon is displayed in the region 116 proximate the edge 104. Moving the top-most tile 136 of the second subset 126 in this manner uncovers a further tile (if any) of the second subset 126 proximate the edge 106 and any indicia imprinted on a surface thereof.

It should be apparent to one who has ordinary skill in the art that all of the tiles of the set of tiles 118 may be stacked atop one another proximate the edge 104 such that none of the set of tiles 118 is disposed proximate the edge 106. In such cases, a portion of the surface 141 of the cavity 115 that otherwise would be covered one of the set of tiles 118 is made visible. Similarly, all of the set of tiles 118 may be stacked atop one another proximate the edge 106 such that none of the tiles of set of tiles 118 is proximate the edge 104, and in such cases the surface 141 of the cavity 115 that otherwise would be covered by one of the set of tiles 118 is made visible.

In some embodiments, portions of the surface 141 of the cavity 115 over which one or more tiles of the sets of tiles 118 may overlie are imprinted with additional characters/symbol(s) that become visible when no tile overlies such area (i.e. when all of the tiles overlying such area have been flipped).

Figure 2:
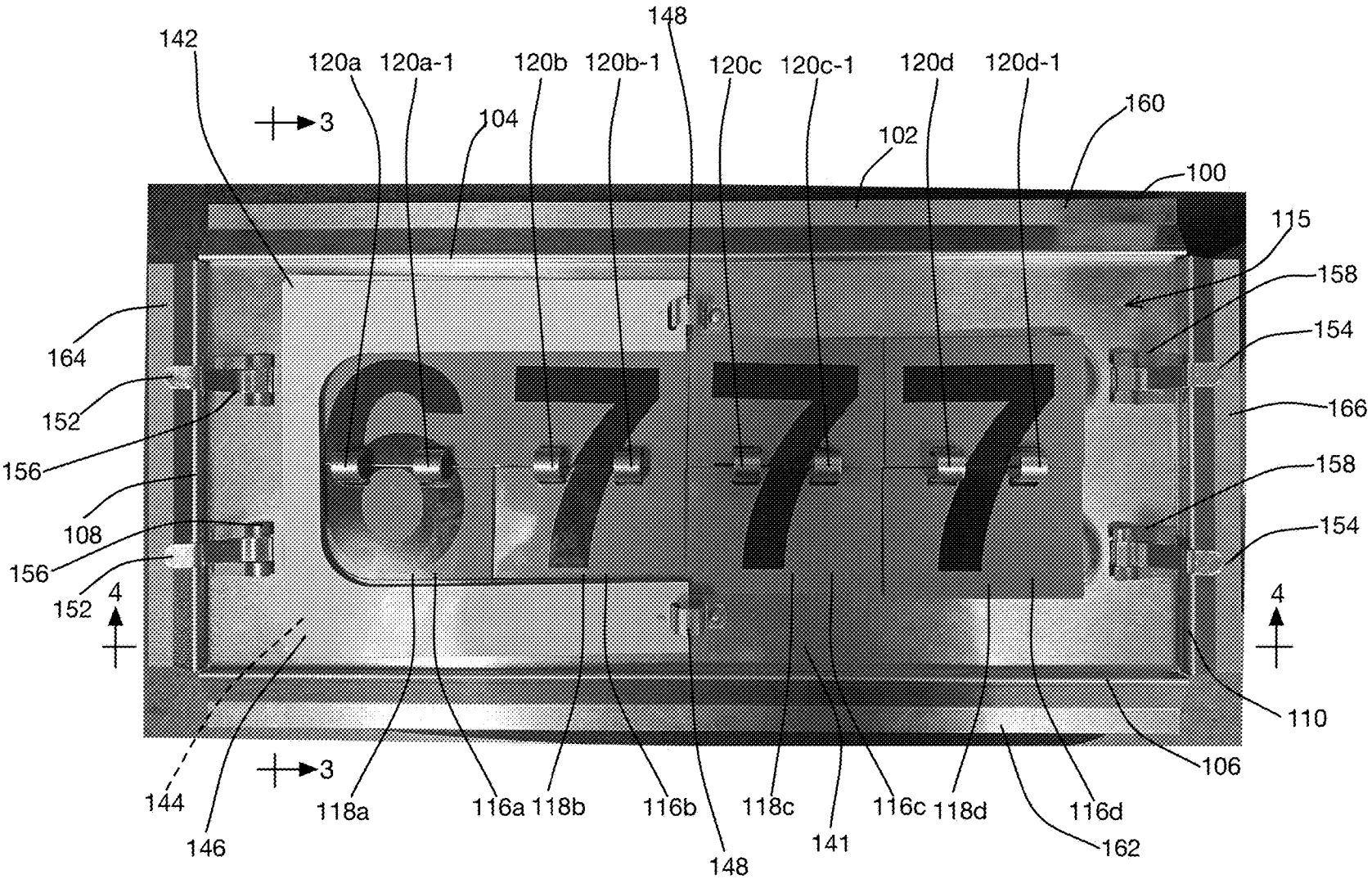
FIG. 2 is an elevational view of the marking device of FIG. 1 with a securing portion disposed in a non-securing position.
Figure 3:
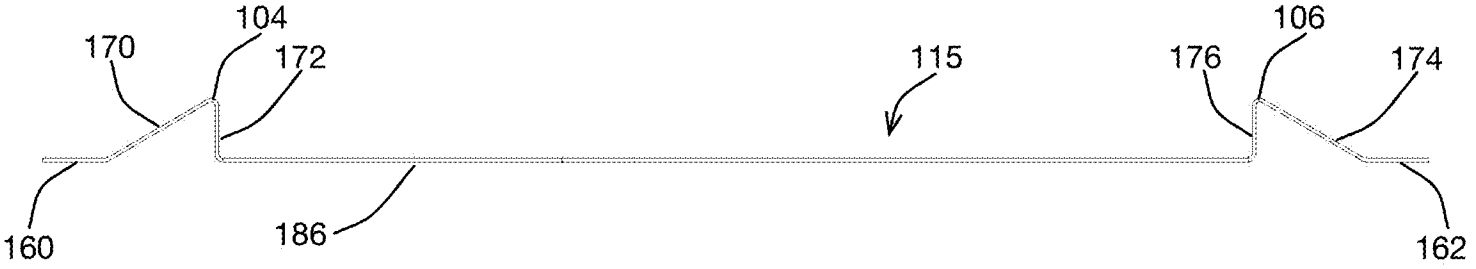
FIG. 3 is a cross-sectional view of the marking device of FIGS. 1 and 2 taken generally along the lines 3-3 of FIG. 2.
Figure 4:
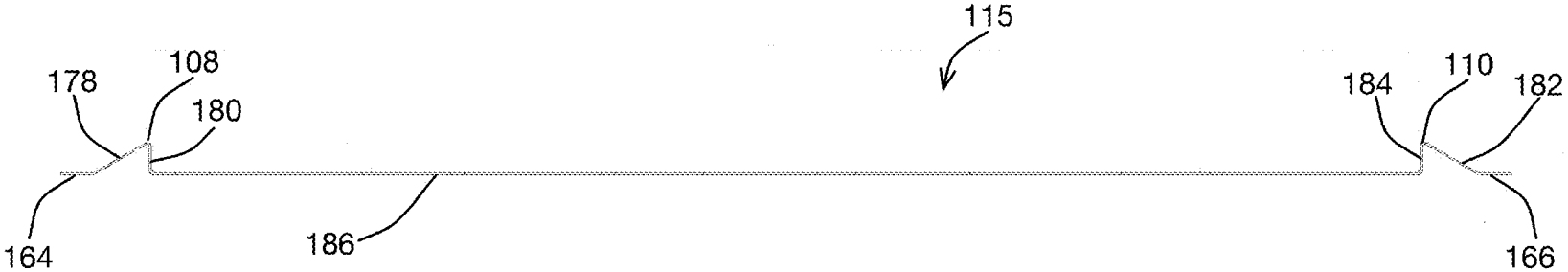
FIG. 4 is a cross-sectional view of the marking device of FIGS. 1 and 2 taken generally along the lines 4-4 of FIG. 2.

With reference to FIGS. 1 and 2, the marking device 100 includes a securing member 142 having a first securing portion 144 and a second securing portion 146. Hinges 148 secure the first securing portion 144 and the second securing portion 146 to the marking device frame 102 so that the first and second securing portions 144,146 are rotatable about the hinges 148. In some embodiments, all of the hinges 148 that secure the first and second securing portions 144,146 are disposed colinearly relative to one another along a line parallel to the second axis 114.

Each of the first and second securing portions 144,146 is movable from a securing position to a non-securing position. As shown in FIG. 1, when in the securing position, the first securing portion 144 overlies one or more of the sets of tiles 116 to block rotation of such tiles about the hinge 120 associated with such set. Similarly, when in the securing position, the second securing portion 146 overlies one or more of the sets of tiles 118 to block rotation of such tiles about the hinge 120 associated with each such set.

FIG. 2 shows the second securing portion 146 rotated about the hinges 148 and moved from the securing position (see FIG. 1) to the non-securing position such that the tile sets 118*c* and 118*d* are not overlaid by the securing portion 146. In this configuration, the tiles that comprise the tile set 118*c* may be rotated about the hinges 120*c* and 120*c*-1 and the tiles that comprise the tile set 118*d* may be rotated about the hinges 120*d* and 102*d*-1 to select and expose the characters/symbols displayed by such tile sets 118*c*, 118*d*. After such characters/symbols have been selected and exposed, the second securing portion 146 may be rotated about the hinges 120*c* and 120*c*-1 to the securing position in which the second securing portion 146 overlies the tile sets 118*c*, 118*d*.

The characters/symbols displayed by the tile sets 118*a*, 118*b* in the regions 116*a*,116*b*, respectively, may be selected in a manner similar to that described above. In particular, the first securing portion 144 is rotated about the hinges 148 and moved from the securing position to the non-securing position so that first securing portion 144 does not overlie the tiles 118*a* and 118*b*. It should be apparent that the second securing portion 144 must be moved into the securing position before the first securing portion 144 can be moved into the non-securing position. When the first securing portion 144 is in the non-securing position, the tiles that comprise the set of tiles 118*a* may be rotated about the hinges 120*a* and 120*a*-1 to select a character/symbol(s) to be displayed in the region 116*a*, and the tiles that comprises the set of tiles 118*b* may be rotated about the hinges 120*a* and 120*a*-1 to select a character/symbol(s) to be displayed in the region 116*b*. Thereafter, the first securing portion 144 may be rotated once again about the hinges 148 to move same from the non-securing position to the securing position in which the first securing portion 144 overlies the tile sets 118*a* and 118*b*.

First and second sets of locking clips 152 and 154, respectively, are disposed in the marking device frame 102. The first set of locking clips 152 is disposed between the first securing portion 142 and the third edge 108 of the marking device frame 102. Each of the first set of locking clips 152 is moveable about a hinge 156 from an unlocked position (shown in FIGS. 1 and 2) to a locked position (not shown). When the first securing portion 142 is in the securing position and the locking clip 152 has been moved into the locked position, such locking clip 152 overlies the securing portion 142.

The second set of locking clips 154 is disposed between the second securing portion 146 and the fourth edge 110. Each of the second set of locking clips 154 is movable about a hinge 158 from an unlocked position (shown in FIGS. 1 and 2) to a locked position (not shown) in which the locking clip 152 overlies the second securing portion 144 disposed in the secured position. It should be apparent that each locking clip 152,154 may be spring-loaded so that such clip remains in the locked position until at least a predetermined force is applied to move the locking clip 152,154 from the locked position to the unlocked position. In some embodiments, the locking clip 152,154 may be identical or substantially similar to that disclosed in Kaufman et al., U.S. patent application Ser. No. 17/092,009, filed Nov. 6, 2020, and entitled "Placard Clip." The entire contents of this application are incorporated herein by reference. One of ordinary skill in the art would appreciate that other types of locking clips 152,154 suitable for holding the securing portions 144,146 in their respective securing positions may be used.

In some embodiments, the marking device frame 102 includes first through fourth flange portions 160-166 that extend outwardly from along a perimeter thereof. One or more such flange portions 160-166 may be fastened to a wall or other surface of a container to secure the marking device 100 to the container. As would be understood by one having ordinary skill in the art, the marking device frame 102 may be secured to the wall/surface of the container using one or more rivets, mating bolts and nuts, one or more screws, one or more welds, adhesive, etc., or combinations thereof.

Referring to FIGS. 1-4, in some embodiments the first edge 104 separates an exterior wall 170 and an interior wall 172, the second edge 106 separates an exterior wall 174 and an interior wall 176, the third edge 108 separates an exterior wall 178 and an interior wall 180, and the fourth edge 110 separates an exterior wall 182 and an interior wall 184 of the marking device frame 102. In some cases, a bottom wall 186 of the cavity 115 is substantially planar and each of the interior walls 172, 176, 180, and 184 extends upwardly from the bottom wall 184 and forms a substantially right angle therewith. Further, an angle spanned between the exterior walls 170, 174, 178, and 182 and the interior walls 172, 176, 180, and 184 at the edges 104, 106, 108, and 110, respectively, is acute. Such acute angle provides a tapered profile to the marking device frame 100 and may help deflect air currents when the marking device frame 100 is disposed on a moving vehicle.

In some embodiments, the flange portions 160-166 are substantially coplanar with one another and the bottom surface 186 of the cavity 115.

Figure 5:
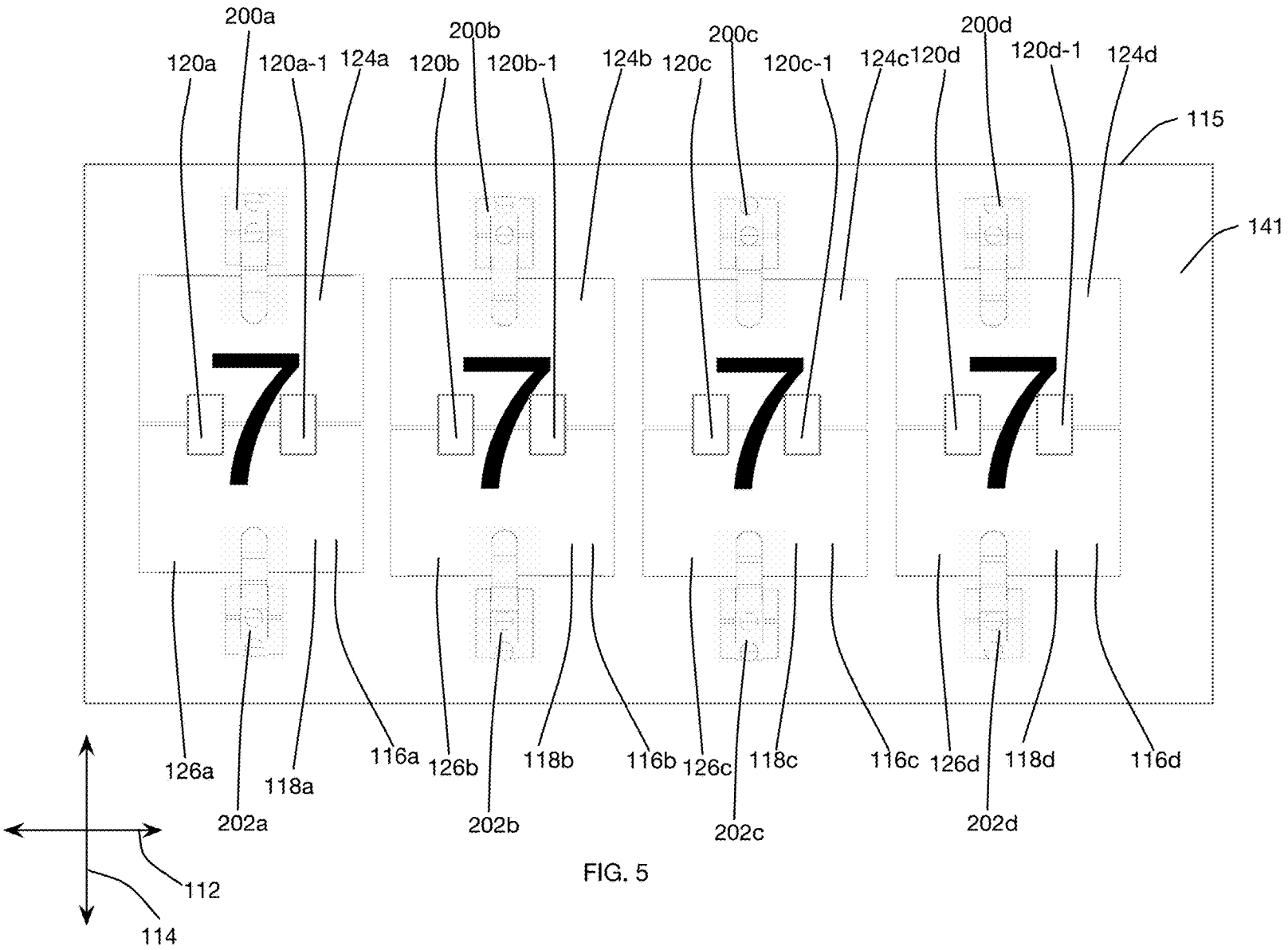
FIG. 5 is an elevational view of another embodiment of a marking device.
Figure 6:
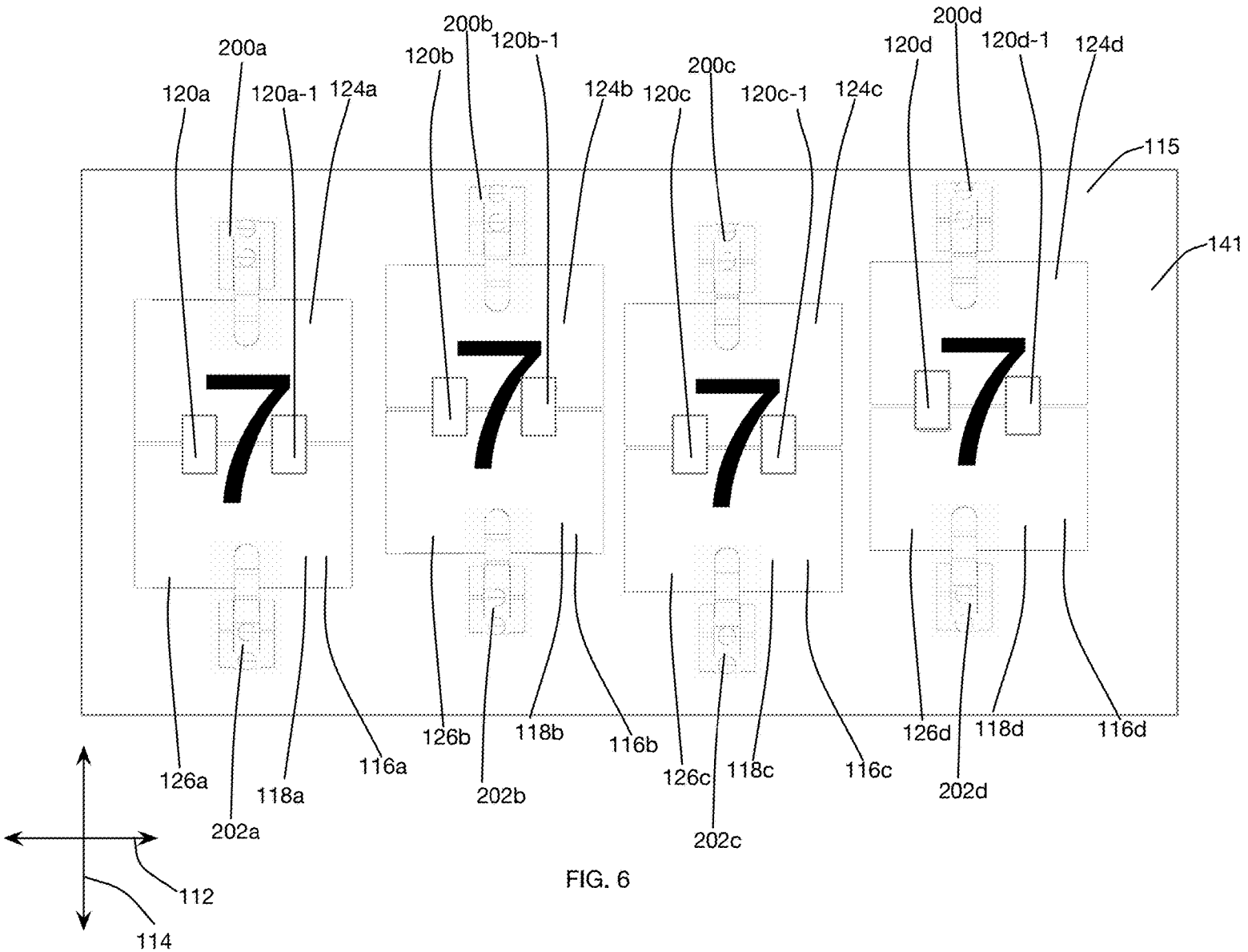
FIG. 6 is an elevational view of a further embodiment of a marking device.

FIGS. 5 and 6 show embodiments of the marking device 100 that are substantially identical to those described hereinabove except these embodiments do not comprise the securing member 142 having securing portions 144,146 that overlie the sets of tiles 118 to block rotation of the tiles about the hinge 120 associated with each such set.

Referring to FIGS. 1, 1A, 5 and 6, after the tiles that comprise the set of tiles 118 are rotated about the hinges 120 as described above to select the indicia displayed in the region 116, a first locking clip 200 and a second locking clip 202 are moved from an unlocked position (not shown) to a locked position to secure the first subset 124 and the second subset 126, respectively, of the set of tiles 118 to the surface 141 of the cavity 115. In some embodiments, when the first and second locking clips 200,202 are in the locked position, the first and second locking clips 200,202 directly contacts the top most tiles of the first and second subsets 124,126, respectively. Further, as shown in FIG. 6, in some embodiments, the hinges 120 do not have to be colinear with one another.

Although the embodiments of the marking device 100 disclosed herein show four display regions 116, it should be apparent to one who has ordinary skill in the art that the marking device 100 may be constructed (e.g., by elongating the first and second edges 104,106) to have more than four display regions 116, and corresponding sets of tiles 118, therein. Similarly, the marking device 100 may be constructed to have fewer than four display regions 116 therein.

In one embodiment, the marking device frame 102, the tiles 118, the securing portions 144,146, the hinges 120,148, the locking clips 152,154,200,202 may be made of a metal such as steel, aluminum, or an alloy, a durable plastic, and the like. In some embodiments, all of these components of the marking device 100 comprise the same material and in other embodiments, these components comprise different materials. In some embodiments, the marking device frame 102 is formed by folding and or bending a sheet of material to form the first through fourth edges 104-108, the interior walls 172,176,180,184, the exterior angled walls 170,174, 178,182, and the flanges 160-166.

It should be apparent to one who has ordinary skill in the art that the embodiments described herein having appropriate indicia may be suitable for use as an orange panel, marking, label, or another display device specified by the U.S. Department of Transportation or another regulatory entity. It should further be apparent that the embodiments described herein may be adapted to display any other type of indicia (e.g., those not regulated by any entity or agency).

INDUSTRIAL APPLICABILITY

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

I claim:

1. A marking device for displaying indicia, comprising:

a substantially rectangular marking device frame comprising first and second edges parallel to a first axis and third and fourth edges parallel to a second axis intersecting the first axis, wherein the first axis and the second axis are orthogonal and define a display direction for the indicia normal to the first axis and the second axis;

a first set of tiles secured to the marking device frame, the first set of tiles comprising a first portion of the indicia;

a second set of tiles secured to the marking device frame, the second set of tiles comprising a second portion of the indicia, wherein the first set of tiles and the second set of tiles are disposed adjacent to one another along the first axis and each set of tiles is movable about a first line parallel to the first axis;

wherein a first tile of the first set of tiles is exposed to display the first portion of the indicia and a second tile of the second set of tiles is exposed to display a second portion of the indicia; and a securing member movable about a second line parallel to the second axis between a securing position at which the securing member engages the first set of tiles and the second set of tiles thereby preventing movement of the first and second sets of tiles about the first line and a non-securing position out of engagement with the first set of tiles and the second set of tiles thereby permitting movement of the sets of tiles about the first line.

2. The marking device of claim 1, wherein the first set of tiles is secured to the marking device frame by a first hinge, the second set of tiles is secured to the marking device frame by a second hinge, and the first and second hinges are disposed along a line parallel to the first axis.

3. The marking device of claim 2, wherein rotating the first tile of the first set of tiles about the first hinge exposes a third tile of the first set of tiles.

4. The marking device of claim 3, wherein the securing member comprises a plurality of securing portions each movable between associated securing and non-securing positions, wherein the first tile is rotatable about the first hinge when one of the securing portions is in the associated non-securing position and wherein the first tile is prevented from being rotated about the first hinge when the one securing portion is in the associated securing position.

5. The marking device of claim 1, wherein the first through fourth edges define a cavity in which the first set of tiles and the second set of tiles are disposed.

6. The marking device of claim 5, further including a locking clip that secures a subset of the first set of tiles to a surface of the cavity.

7. The marking device of claim 5, wherein the first edge separates an inner wall and an outer wall of the marking device frame, wherein the inner wall is substantially perpendicular to a bottom wall of the cavity and the outer wall forms an acute angle with the inner wall.

8. The marking device of claim 1, wherein the marking device frame comprises a flange that extends about the perimeter of the marking device frame.

9. A marking device for displaying indicia, comprising:

a substantially rectangular marking device frame comprising first and second edges parallel to a first axis and third and fourth edges parallel to a second axis, wherein the first and second axes are orthogonal;

a first set of tiles secured to the marking device frame;

a second set of tiles secured to the marking device frame, wherein the first set of tiles and the second set of tiles are disposed adjacent to one another along the first axis;

wherein a first tile of the first set of tiles is exposed to display a first portion of the indicia and a second tile of the second set of tiles is exposed to display a second portion of the indicia;

wherein the first set of tiles is secured to the marking device frame by a first hinge, the second set of tiles is secured to the marking device frame by a second hinge, and the first and second hinges are disposed along a line parallel to the first axis, wherein rotating the first tile of the first set of tiles about the first hinge exposes a third tile of the first set of tiles;

further comprising a securing portion movable from a securing position to a non-securing position, wherein the first tile is rotatable about the hinge when the securing portion is in the non-securing position and is prevented from being rotated about the hinge when the securing portion is in the securing position; and wherein the securing portion comprises a first securing portion, the securing position comprises a first securing position, and the non-securing position comprises a first non-securing position, further comprising a second securing portion movable from a second securing position to a second non-securing position, wherein when the first securing portion is in the first non-securing position, the second securing portion is in the second securing position.

10. The marking device of claim 9, further comprising a first locking clip disposed proximate the third edge and a second locking clip disposed proximate the fourth edge, wherein the first locking clip prevents movement of the first securing portion and the second locking clip prevents movement of the second securing portion.

11. A method of displaying indicia in a marking device, wherein the marking device includes a substantially rectangular marking device frame comprising first and second edges parallel to a first axis and third and fourth edges parallel to a second axis, wherein the first and second axes are orthogonal and define a display direction for the indicia normal to the first axis and the second axis, comprising the steps of:

movably securing a first set of tiles to the marking device frame, the first set of tiles comprising a first portion of the indicia;

movably securing a second set of tiles to the marking device frame, the second set of tiles comprising a second portion of the indicia, wherein the first set of tiles and the second set of tiles are disposed adjacent to one another along the first axis;

exposing one of the first set of tiles to display the first portion of the indicia including the step of moving the one of the first set of tiles about a first line parallel to the first axis;

exposing one of the second set of tiles to display the second portion of the indicia including the step of moving the one of the second set of tiles about the first line parallel to the first axis; and moving a securing member about a second line parallel to the second axis into engagement with the one of the first set of tiles and the one of the second set of tiles to prevent movement of the one of the first and second set of tiles.

12. The method of claim 11, wherein securing the first set of tiles comprises securing the first set of tiles to the marking device frame by a first hinge, securing the second set of tiles comprises securing the second set of tiles to the marking device frame by a second hinge, and disposing first and second hinges along a line parallel to the first axis.

13. The method of claim 12, further including rotating the first tile of the first set of tiles about the first hinge to expose a third tile of the first set of tiles.

14. The method of claim 13, further including moving the securing member from a securing position to a non-securing position to enable the first tile to rotate about the first hinge and moving the securing portion from the securing position to the non-securing position to prevent the first tile from rotating about the first hinge.

15. The method of claim 11, wherein the step of movably securing the first set of tiles comprises the step of disposing the first set of tiles in a cavity defined by the first through fourth edges.

16. The method of claim 15, further including the step of operating a locking clip to secure the first set of tiles to a surface of the cavity.

17. The method of claim 15, further including the step of forming the first edge between an inner wall and an outer wall of the marking device frame, wherein the inner wall is substantially perpendicular to a surface of the cavity and the outer wall forms an acute angle with the inner wall.

18. The method of claim 11, further including the step of forming a flange that extends about the perimeter of the marking device frame.

19. A method of displaying indicia in a marking device, wherein the marking device includes a substantially rectangular marking device frame comprising first and second edges parallel to a first axis and third and fourth edges parallel to a second axis, wherein the first and second axes are orthogonal, comprising the steps of:

securing a first set of tiles to the marking device frame;

securing a second set of tiles to the marking device frame, wherein the first set of tiles and the second set of tiles are disposed adjacent to one another along the first axis;

exposing one of the first set of tiles to display a first portion of the indicia;

exposing one of the second set of tiles to display a second portion of the indicia; wherein securing the first set of tiles comprises securing the first set of tiles to the marking device frame by a first hinge, securing the second set of tiles comprises securing the second set of tiles to the marking device frame by a second hinge, and disposing first and second hinges along a line parallel to the first axis;

rotating the first tile of the first set of tiles about the first hinge to expose a third tile of the first set of tiles; and moving a securing portion from a securing position to a non-securing position to enable the first tile to rotate about the hinge and moving the securing portion from the non-securing position to the securing position to prevent the first tile from rotating about the hinge;

wherein the securing portion comprises a first securing portion, the securing position comprises a first securing position, and the non-securing position comprises a first non-securing position, further comprising moving a second securing portion from a second securing position to a second non-securing position, wherein when the first securing portion is in the first non-securing position, the second securing portion is in the second securing position.

20. The method of claim 19, further including the steps of disposing a first locking clip proximate the third edge, disposing a second locking clip proximate the fourth edge, moving the first locking clip into a first locking position to prevent movement of the first securing portion, and moving the second locking clip into a second locking position to prevent movement of the second securing portion.

* * * * *